United States Patent [19]

Kitanaka

[11] Patent Number: 5,013,191

[45] Date of Patent: May 7, 1991

[54] CAST-IN-PLACE PILING METHOD AND APPARATUS

[76] Inventor: Katsumi Kitanaka, 24-8, Sakuragaoka-Cho, Shibuya-Ku, Tokyo, Japan

[21] Appl. No.: 458,363

[22] Filed: Dec. 28, 1989

[30] Foreign Application Priority Data

| | | | |
|---|---|---|---|
| Jan. 9, 1989 | [JP] | Japan | 1-1174 |
| May 31, 1989 | [JP] | Japan | 1-136139 |
| Jul. 3, 1989 | [JP] | Japan | 1-171591 |

[51] Int. Cl.[5] ..... E02D 5/34

[52] U.S. Cl. ..... 405/233; 175/394; 299/87; 405/232

[58] Field of Search ..... 405/240, 241, 242, 243, 405/244, 266, 267, 263, 232, 233, 237, 248; 175/254, 251, 244, 249, 245, 394; 299/87

[56] References Cited

U.S. PATENT DOCUMENTS

| | | | |
|---|---|---|---|
| 2,352,326 | 6/1944 | Kandle | 175/394 X |
| 2,401,250 | 5/1946 | Kandle | 175/394 X |
| 2,578,014 | 12/1951 | Petersen | 175/394 X |
| 2,751,203 | 6/1956 | Compton | 299/87 |
| 3,690,109 | 9/1972 | Turzillo | 405/241 |
| 4,180,350 | 12/1979 | Watts | 405/240 X |
| 4,269,544 | 5/1981 | Rusche | 405/233 X |
| 4,618,289 | 10/1986 | Federer | 405/239 X |

FOREIGN PATENT DOCUMENTS

| | | |
|---|---|---|
| 570464 | 1/1933 | Fed. Rep. of Germany . |
| 3439621 | 7/1986 | Fed. Rep. of Germany . |
| 1388583 | 12/1964 | France . |
| 712261 | 12/1951 | United Kingdom . |
| 1026094 | 4/1964 | United Kingdom . |
| 2137678 | 4/1983 | United Kingdom . |

*Primary Examiner*—Dennis L. Taylor

*Attorney, Agent, or Firm*—Stevens, Davis, Miller & Mosher

[57] ABSTRACT

An apparatus for piling a cast-in-place pile includes an earth auger main body and an auger head. The earth auger main body includes a hollow shaft, a spiral screw blade provided about the hollow shaft, a spiral belt provided on an outer circumference of the spiral screw blade and in parallel with an outer circumferential surface of the hollow shaft. The auger head is connected to a lower end of the earth auger main body and includes a holow shaft, one or two spiral screw blades provided about the hollow shaft, one or two spiral belts provided on outer circumferences of the spiral screw blades and in parallel with the outer circumferential surface of the hollow shaft, and excavating bits provided at a lower end of the spiral screw blades, and device for preventing excavated earth and sand from flowing in a return direction when the auger head is rotated in a reverse direction.

18 Claims, 16 Drawing Sheets

15
13

13
24
4
24
9
26
25

27
26
25

28
26
29
25

15
29

CAST-IN-PLACE PILING METHOD AND APPARATUS

BACKGROUND OF THE INVENTION

This invention relates to a method of piling a cast-in-place concrete pile widely used as a foundation in construction works and an apparatus for carrying out the method.

There have been various methods of piling cast-in-place piles such as Benote piling method, reverse piling method, earth drill piling method, deep foundation piling method and the like. The method according to the invention comes within the earth drill piling method.

In the earth drill piling method, excavating is directly effected by means of a rotary bucket without protecting the walls of excavated holes from crumbling. In the event that walls of an excavated hole require to be prevented from falling down, muddy water as bentonite suspension is used.

In excavating with the rotary bucket, after the bucket has been filled with excavated earth and sand, the bucket is once pulled up to exhaust the earth and sand out of the excavated hole, and thereafter the bucket is again inserted into the hole. Such an operation is repeated many times. Therefore, the time for the excavating work becomes longer by the time required for exhausting the excavated earth and sand in the bucket.

In case that muddy water such as bentonite suspension or the like is used for preventing the walls of the hole from crumbling, as the excavated earth and sand will mixed with the bentonite suspension to produce so-called industrial waste. If the industrial waste is not properly treated, it will cause an environmental pollution.

SUMMARY OF THE INVENTION

It is an object of the invention to provide a cast-in-place piling method and an apparatus for the method which will eliminate all the disadvantages of the prior art and which can considerably improve operation efficiency for piling concrete piles without crumbling walls of excavated holes and without causing any environmental pollution.

In order to accomplish this object, a cast-in-place piling method according to the invention comprises the steps of excavating a ground to a predetermined depth by rotating in a normal direction an earth auger including an earth auger main body having a hollow shaft, a spiral screw blade provided about the hollow shaft, and a spiral belt provided on an outer circumference of the spiral screw blade and in parallel with an outer circumferential surface of the hollow shaft, and an auger head provided at a lower end of the earth auger main body and having check means for preventing excavated earth and sand from flowing in a return direction when the earth auger is rotated in a reverse direction; once rotating said earth auger in the reverse direction and pulling up the earth auger together with excavated earth and sand; inserting reinforcing steels into an excavated hole; and pouring cement paste through a tremie pipe into the excavated hole to successively accumulate from a bottom to a top of the hole.

In pulling up the earth auger, bentonite suspension or water may be poured through a hole of the hollow shaft into the excavated hole to replace the excavated earth and sand in the excavated hole with the bentonite suspension.

In pulling up the earth auger, moreover, the cement paste in the final step is poured through a hole of the hollow shaft into the excavated hole without inserting the reinforcing steel in the next step.

An apparatus for piling a cast-in-place pile according to the invention comprises an earth auger main body having a hollow shaft, a spiral screw blade provided about the hollow shaft, a spiral belt provided on an outer circumference of the spiral screw blade and in parallel with an outer circumferential surface of the hollow shaft; and an auger head connected to a lower end of the earth auger main body and having a hollow shaft, a spiral screw blade provided about the hollow shaft, excavating bits provided at a lower end of the spiral screw blade, and check means provided in the proximity of the lower end of the spiral screw blade for preventing excavated earth and sand from flowing in a return direction when the auger head is rotated in a reverse direction.

As above described, in the invention, use is made of the earth auger main body comprising the spiral screw blade provided about the hollow shaft and the spiral belt provided on the circumference of the spiral screw blade in parallel with the outer circumferential surface of the hollow shaft. Therefore, the excavated earth and sand are held about the hollow shaft by means of the screw blade and spiral belt.

Moreover, according to the invention, excavating is effected to a predetermined depth using the earth auger having the earth auger main body to which is connected the auger head provided with check means for preventing the excavated earth and sand from flowing in the return direction when the auger head is rotated in the reverse direction. Then, after the earth auger is once rotated in the reverse direction, the earth auger is pulled up according to the invention. The excavated earth and sand accumulated in the grooves of the earth auger are prevented from flowing in the return direction, while the earth auger is pulled up out of the excavated hole together with the excavated earth and sand held in the grooves through out the entire length of the earth auger.

In pulling up the earth auger, bentonite suspension is poured into the hole of the hollow shaft to replace the excavated earth and sand with the bentonite suspension and then after reinforcing steels are inserted into the excavated hole, cement paste is poured through the tremie pipe into the hole to accumulate the cement paste from the bottom to the top. According to the invention, excavating can be continuously effected to the predetermined depth, while the excavated earth and sand can be replaced with bentonite suspension by pulling up the earth auger. In case of concrete pile having no reinforcing steels, the excavated earth and sand can be directly replaced with cement paste.

According to the invention, therefore, the work efficiency is considerably improved and walls of the excavated hole hardly crumble when the earth auger is being pulled up so that slime scarcely remains at the bottom of the excavated hole.

Moreover, the excavated earth and sand ar statically replaced with the muddy water such a bentonite suspension so as not to mix the excavated earth and sand with the bentonite suspension, with the result that industrial waste is not produced which will cause an environmental pollution. According to the invention the excavated earth and sand are exhausted out of the excavated hole without mixing with bentonite suspension and the like. Therefore, the excavated earth and sand are easily handled and treated, while they can be effectively utilized as reclamation.

In a preferable embodiment of the invention, the check means comprises bottom plates fixed to the lower end of the spiral belt of the auger head except the proximity of the excavating bits, the excavating bits being pivotable relative to the bottom plates to close and open openings of the bottom plates, and stoppers pivotally connected to the bottom plates and moved by excavated earth and sand to engage the excavating bits to maintain it in a close position.

With this arrangement, the spiral belt is also provided on the auger head so that the holding of the excavated earth and sand by the auger head is enhanced to further reduce crumbling of the excavated earth and sand.

In another embodiment, the stoppers are in the form of arms whose bottoms are pivotally connected to the bottom plates and whose free ends are formed with resistance pieces on which earth and sand being excavated act to move the stoppers clear of the excavating bits, while the free ends of the stoppers engage projecting pieces of the excavating bits to hold the bits in their closed positions when the auger head is rotated in the reverse direction.

The spiral belt is preferably fixed with its lower edge to the screw blade of the auger head or the screw blade of the earth auger main body. In this manner, the prevention of the excavated earth and sand from crumbling is improved.

Moreover, the spiral screw blades may be doubly provided about the hollow shaft of the auger head.

In a further embodiment of the invention, the check means comprises bottom plates fixed to the lower end of the spiral belt of the auger head except the proximity of the excavating bits, the excavating bits being pivotable relative to the bottom plates to close and open openings of the bottom plates, and elastic plates provided inside the bottom plates and having edges fixed to the bottom plates for covering areas which are not covered by the bottom plates at the lower end of the spiral belt.

With this arrangement, when excavating, the elastic plates are bent upwardly to receive the earth and sand excavated by the bits in the auger head, while when pulling up the auger head after completion of the excavating, the elastic plates return into horizontal positions to automatically close the openings of the bottom plates, thereby preventing the excavated earth and sand in the auger head from falling down.

Accordingly, the earth and sand remaining in the excavated hole are eliminated in a reliable manner by using the apparatus according to the invention.

The invention will be more fully understood by referring to the following detailed specification and claims taken in connection with the appended drawings.

DETAILED EXPLANATION OF PREFERRED EMBODIMENTS

FIGS. 1-5 illustrate an apparatus or earth auger for carrying out the cast-in-place piling method according to the invention.

Figure 1:
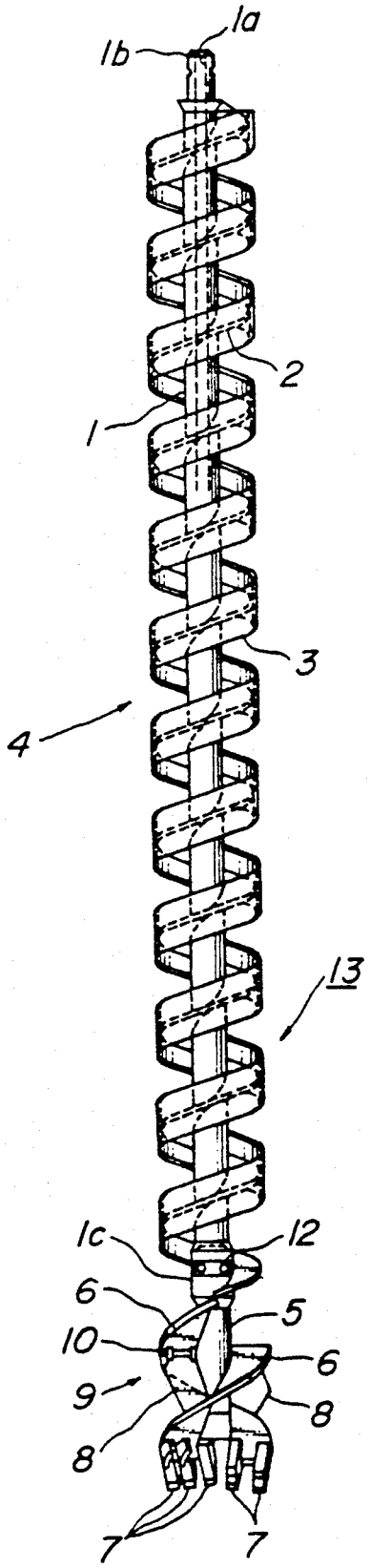
FIG. 1 is a general view illustrating one embodiment of an apparatus according to the invention.
Figure 2:
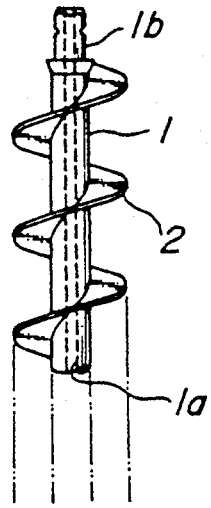
FIG. 2 is a partial view illustrating a condition during manufacturing the apparatus shown in FIG. 1.
Figure 3:
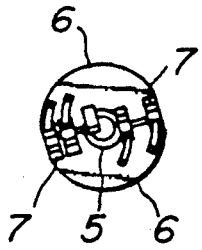
FIG. 3 is a bottom plan view of the earth auger shown in FIG. 2.

The earth auger according to the invention comprises a hollow shaft 1 having a hole in its center axis, a spiral screw blade 2 (FIG. 2) about the hollow shaft 1, a spiral belt 3 wound about and fixed as by welding to an outer circumference of the screw blade 2 in parallel with an outer circumferential surface of the hollow shaft 1 as shown in FIG. 1 to form an integral earth auger main body 4. A coupling insert shaft 1*b* and a coupling sleeve 1*c* are provided at upper and lower ends of the hollow shaft 1.

Figure 4:
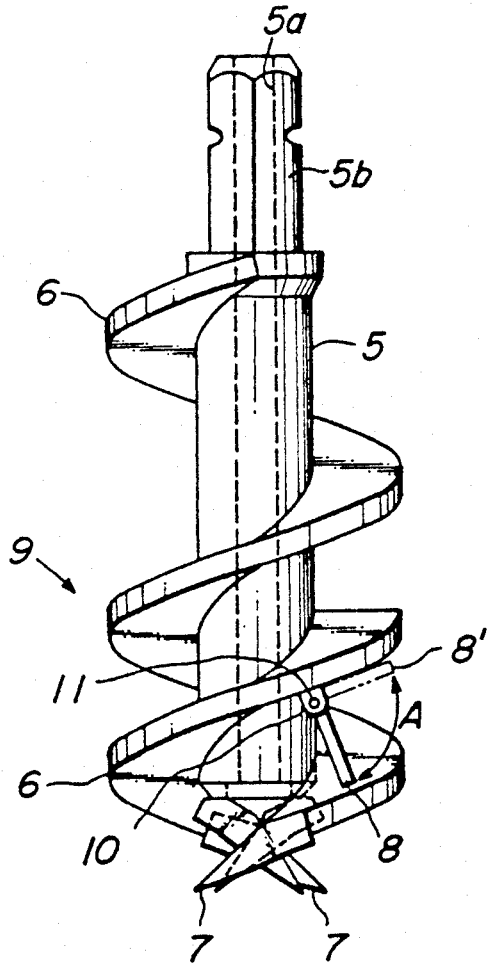
FIG. 4 is a front elevation illustrating one embodiment of an auger head according to the invention.

As shown in FIGS. 1, 3, 4 and 5, a spiral screw blade 6 is provided about a hollow shaft 5 having a hole 5*a* in its center axis. If required, pitches of the spiral screw blade 6 are made smaller at a lower portion of the hollow shaft 5 as shown in FIG. 4. The screw blade 6 is provided with excavating bits 7 at a lower end of the screw blade 6 and with a check plate 8 above the excavating bits 7 for preventing excavated earth and sand from flowing in a return direction to form an integral auger head 9.

The "return direction" used herein means a flowing direction of the excavated earth and sand relative to the auger head reverse to a flowing direction of the earth and sand in excavating.

The check plate 8 is, for example, as shown in FIG. 4, pivotally connected by a pin 11 to a bracket 10 provided on the screw blade 6 rockably as shown by an arrow A. When the auger head 9 is being rotated, the check plate 8 assumes a position shown in broken lines 8' in FIG. 4. When the auger head 9 is being rotated in a reverse direction, the check plate 8 is rotated to a position shown in solid lines to prevent the earth and sand between parts of the screw blade 6 from flowing in the return direction.

The hollow shaft 5 is provided at the upper end with a coupling insert shaft 5*b*. The coupling insert shaft 5*b* is inserted into the coupling sleeve 1*c* shown in FIG. 1, and two bolts 12 are inserted therebetween so that the earth auger main body 4 and the auger head 9 are connected to form an earth auger 13 for a cast-in-place pile.

The cast-in-place piling method according to the invention will be explained referring to FIG. 6 which is carried out by the use of the earth auger 13 according to the invention.

Referring to FIG. 6, reference numeral 15 denotes an earth or ground and a boring machine 16 settled on the ground including a crawler 17, a swivel base 18 provided on the crawler 17, an outrigger 19, a leader 20 upstanding on a front end of the swivel base 18, a back stay 21 for the leader 20, a back tensioner 22 and a rotating driving device 23 for an earth auger liftably hanged on a front surface of the leader 20.

Figure 6A:
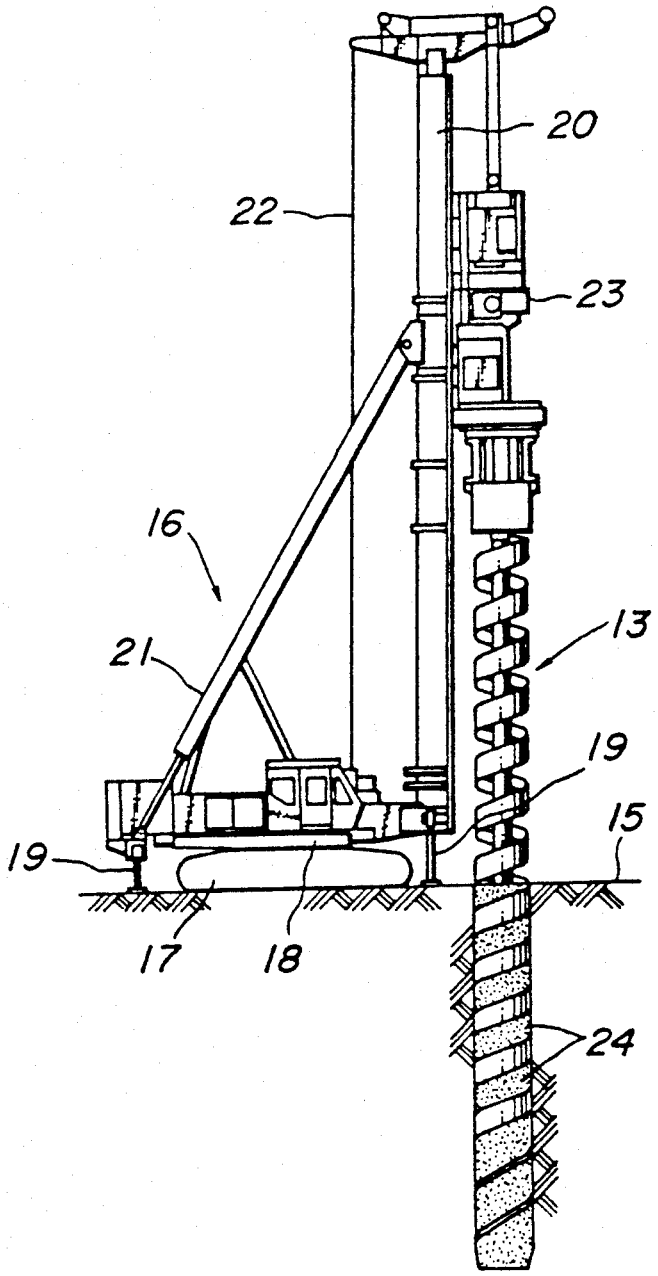
FIGS. 6*a*-6*f* are explanatory views for explaining steps of the method according to the invention.

According to the invention, an earth auger 13 is hung below the rotating driving device 23 liftably provided on the front surface of the leader 20 of the boring machine 16 and the earth auger 13 is driven and is rotated into the ground 15 as shown in FIG. 6*a*.

In this manner, the earth and sand excavated by the excavating bits 7 at the lower end of the auger head 9 provided at the lower portion of the earth auger 13 are turned upwardly with the aid of the screw-blade 6 so as to enter between parts of the screw blade 2 of the earth auger main body 4.

During such operations, the earth auger 13 is progressively driven into the ground 15 so that the excavated earth and sand fill grooves between the parts of the screw blades 6 and 2 of the earth auger 13 in the ground 15 as shown in FIG. 6*a*.

Figures 6B, 6C, 6D, 6E, 6F:
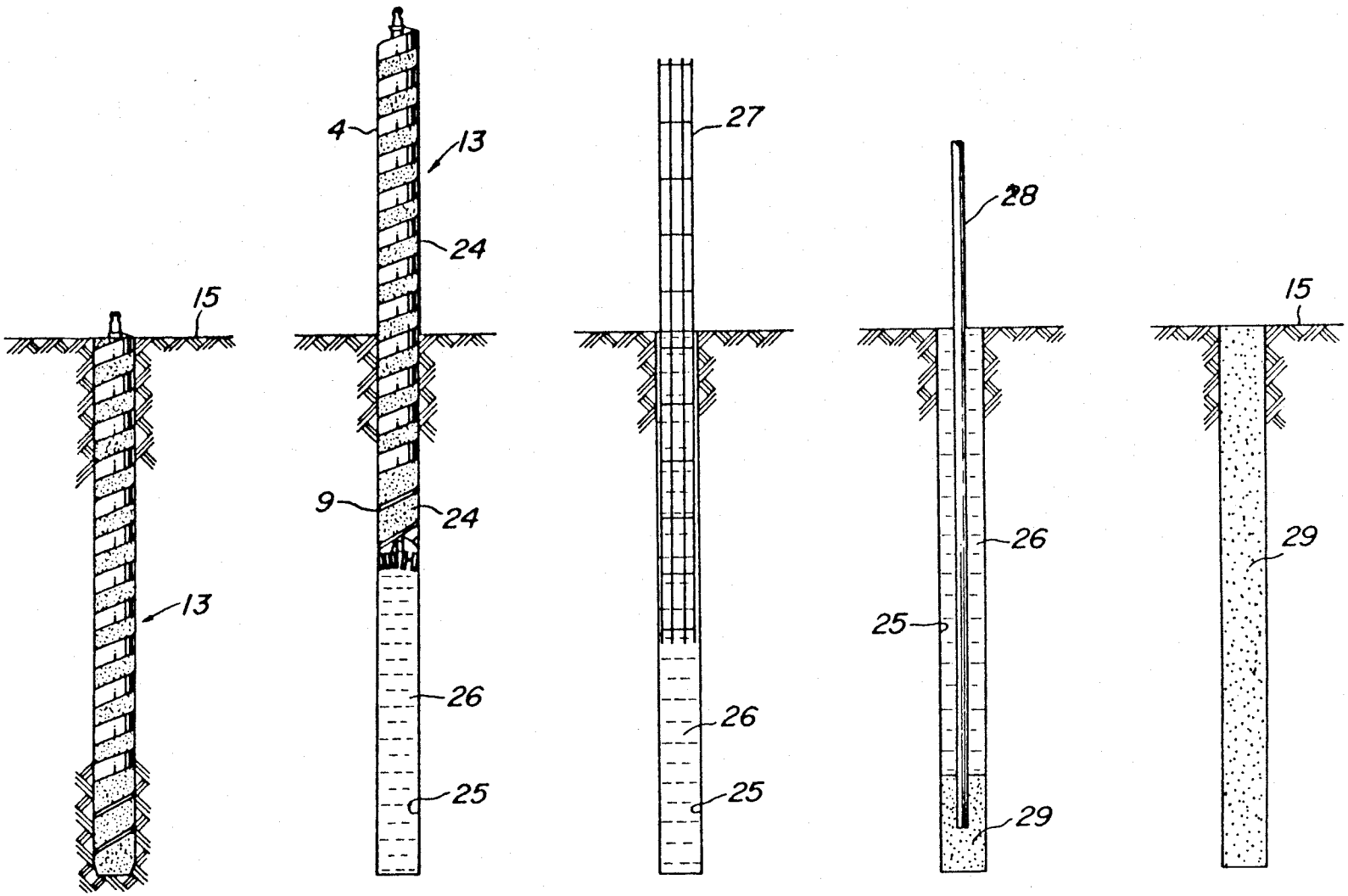

The hole excavating operation is continued until the earth auger 13 arrives at a position having a predetermined depth as shown in FIG. 6*b*. Only one earth auger 13 is shown in FIG. 6*b*. If one earth auger 13 is insufficient to arrive at a required depth, additional earth auger main bodies 4 may be sequentially connected to effect the excavation of hole.

When an excavated hole 25 has arrived at a predetermined depth, the earth auger 13 is once rotated in a reverse direction as shown in FIG. 6*c*. Upon rotating in the reverse direction, the check plate 8 is rotated from the position in the broken lines 8' to the position in the solid lines 8 as above described to prevent the earth and sand 24 filled in the parts of the screw blade 6 from flowing in a return direction. In this case, the earth and sand 24 filled between the parts of the screw blade 6 are prevented from being removed from the earth auger main body 4 by the spiral belt 3 even after the earth auger has been pulled up above the ground.

In pulling up the earth auger 13, bentonite slurry or suspension 26 is poured through the holes 1*a* and 5*a* of the hollow shafts 1 and 5 of the earth auger 13 into the excavated hole 25. Therefore, when the earth auger 13 is pulled up in this step, the excavated earth and sand 24 are exhausted out of the hole, while the bentonite suspension is filled in the hole in substitution for the earth and sand 24.

After the earth auger 13 has been completely removed from the excavated hole 25 in this manner, reinforcing steel 27 is inserted into the bentonite suspension 26 in the excavated hole 25 as shown in FIG. 6*d* and arranged in position therein.

A tremie pipe 28 is then inserted into the excavated hole 25, and cement paste is poured through the tremie pipe 28 into the excavated hole 25 to fill the cement paste from the bottom of the hole 25 so that the cement paste is filled in the hole 25 in substitution for the bentonite suspension 26 as shown in FIG. 6*e*.

FIG. 6*f* illustrates a complete cast-in-place concrete pile in the manner as above described.

In the present invention, moreover, water may be used instead of the bentonite suspension 26.

In the case that walls of an excavated hole hardly crumble or collapse as in a ground of loam or silt layer, pouring of the bentonite suspension or water may be omitted after excavating the hole.

Moreover, for making a cast-in-place concrete pile having no reinforcing steels, in pulling up the earth auger 13 after excavating a hole, concrete paste may be directly poured through the holes of the hollow shafts into the excavated hole.

As above described, according to the invention, use is made of the earth auger main body 4 comprising the hollow shaft 1 provided thereabout with the spiral screw blade 2 about which the spiral belt 3 is provided in parallel with the outer circumference of the hollow shaft. Therefore, excavated earth and sand are held about the hollow shaft 1 with the aid of the screw blade 2 and the spiral belt 3 without dislodgement therefrom.

According to the invention, moreover, the auger head 9 provided with the check plate 8 for preventing the excavated earth and sand 24 from flowing in the return direction is connected to the lower end of the earth auger main body 4 to form the earth auger 13, and after excavating the ground 15 to a predetermined depth, the earth auger is once rotated in the reverse direction and then pulled up out of the hole. Therefore, the earth and sand 24 accumulated in the groove of the earth auger 13 is prevented from flowing in the return direction by the check plate 8, and the earth auger 13 can be pulled up out of the hole together with the excavated earth and sand 24 held in the groove of the earth auger 13 over its entire length.

In pulling up the earth auger 13, bentonite paste 26 is poured through the holes 1*a* and 5*a* of the hollow shafts 1 and 5 into the excavated hole 25 to replace the excavated earth and sand 24 with the bentonite suspension 26. Reinforcing steel is then inserted into the hole, and thereafter concrete paste 29 is poured through a tremie pipe into the hole to pile the cement paste progressively from the bottom of the hole so that the bentonite suspension 26 is replaced with the cement paste 29. According to the invention, therefore, excavating can be effected continuously to a predetermined depth by means of the earth auger 13, while the excavated earth and sand 24 in the hole 25 are replaced with the bentonite suspension 26 by pulling up the earth auger 13. In case of a cast-in-place concrete pile having no reinforcing steel, moreover, the excavated earth and sand may be directly replaced with the concrete paste 29.

As above described, according to the invention the excavating operation can be carried out continuously by means of the earth auger 13. It has been ascertained from result of experiments that the operation efficiency is improved twice that in the earth drill method of the prior art.

As can be seen from the above explanation, according to the invention the operation efficiency is considerably improved and walls of an excavated hole hardly crumble when the earth auger is being pulled up so that slime scarcely remains at the bottom of the excavated hole. Therefore, the invention has a significant effect that high quality cast-in-place piles can be obtained.

According to the invention, moreover, as excavated earth and sand are statically replaced with muddy water such as bentonite suspension, the excavated earth and sand and the bentonite suspension are not mixed with each other so that no industrial waste resulting from such a mixture is produced which would cause an environmental pollution. According to the invention the excavated earth and sand are exhausted out of the hole separately without mixing with the bentonite suspension. Therefore, the invention has superior effects in prevention of public nuisance and in economical viewpoint that the excavated earth and sand are easily disposed, while they can be effectively utilized as reclamation.

Figure 7:
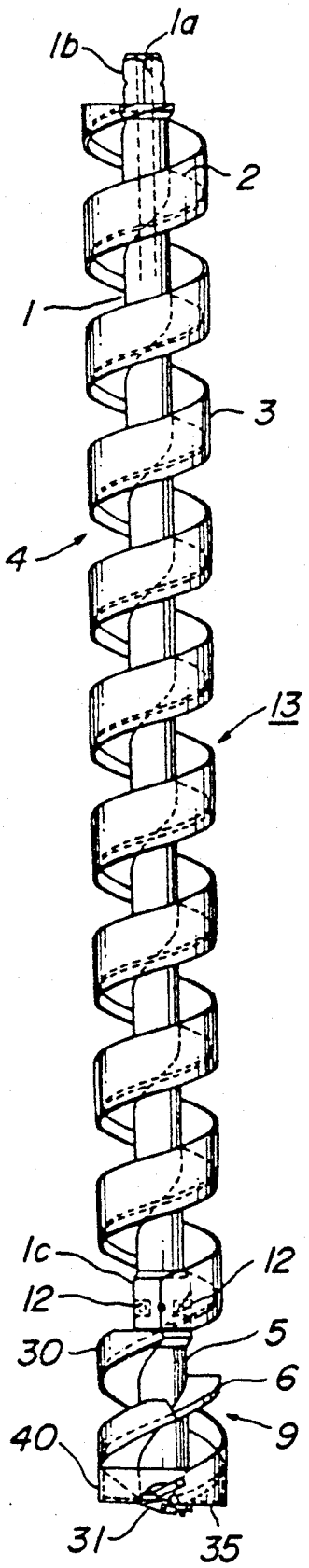
FIG. 7 is a general view illustrating a second embodiment of the apparatus according to the invention.

FIG. 7 illustrates another embodiment of the apparatus or earth auger according to the invention. An earth auger main body shown in FIG. 7 is substantially the same as that shown in FIG. 1 and will not be described in further.

As shown in FIGS. 7 to 11*a* and 11*b*, an auger head 9 comprises a hollow shaft 5 having a center hole 5*a* and provided with spiral screw blades 6 doubly wound about the hollow shaft 5 like a double threaded screw. Spiral belts 30 are provided on outer circumferences of the screw blades 6 in parallel with an outer circumferential surface of the hollow shaft 5. Excavating bits 31 are pivotally provided at lower ends of the screw blades 6 by means of shafts 32 horizontally extending at a bottom of an auger head, respectively.

Each of the two excavating bits 31 is a rectangular viewed in a plan view, whose one side is formed with a plurality of notches 31*a* in the form of a substantially comb-shape. A bracket 33 fixed to an auger head main body is fitted into the notches 31*a*, and the shaft 32 is inserted into the fitted portion of the bracket 33 to pivotally support the excavating bit 31. A bracket 34 is provided at a center of the bottom of the auger head in a manner being interposed between the excavating bits 31 (FIG. 10*b*).

Each of the excavating bits 31 has a front edge 31*b* in the form of wedge in vertical section and a stepped projecting piece 31*c* at a rear end.

Bottom plates 35 of the auger head are fixed to the lower ends of the hollow shaft 5 and to the spiral belts 30 except the fitted portions of the excavating bits 31 in a manner that the excavating bits 31 are pivotally movable relative to the bottom plates 35 to close and open the auger head. Arm-shaped stoppers 36 are pivotally connected with their bottoms to lower surfaces of the bottom plates 35 adjacent the rear edges of the excavating bits 31 by means of shafts 37. The stoppers 36 are provided on their free ends with resistance pieces 36*b* downwardly extending.

Support members 38 are fixed to the lower ends of the screw blades 6 so as to abut against the projecting pieces 31*c* of the excavating bits 31 to keep the bits 31 in excavating positions when the earth auger is rotated in excavating. Moreover, the bottom plates 35 are provided with stopping pieces 39. When the earth augers are rotated in excavating, the earth and sand act on the resistance pieces 36*b* to rotate the stoppers 36 about the shaft 37. In such a rotation of the stoppers 36, the stopping pieces 39 abut against the free end 36*b* of the stoppers 36 to keep the stoppers 36 spaced from the projecting pieces 31*c* of the excavating bits 31.

Figure 10A:
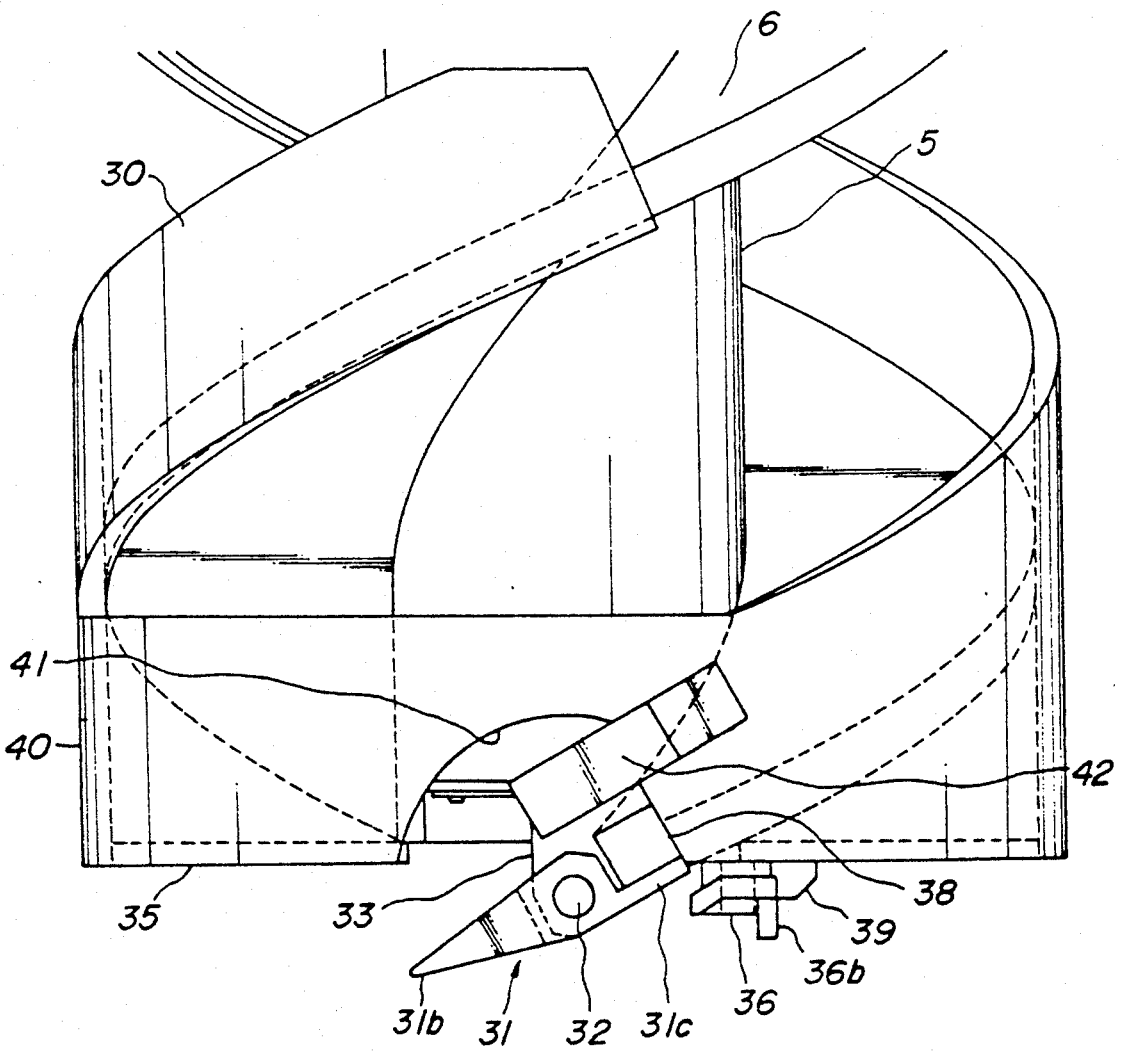
FIG. 10*a* is a partial view illustrating a status of excavating bits of the auger head shown in FIG. 8*a* in an operative condition.
Figure 10B:
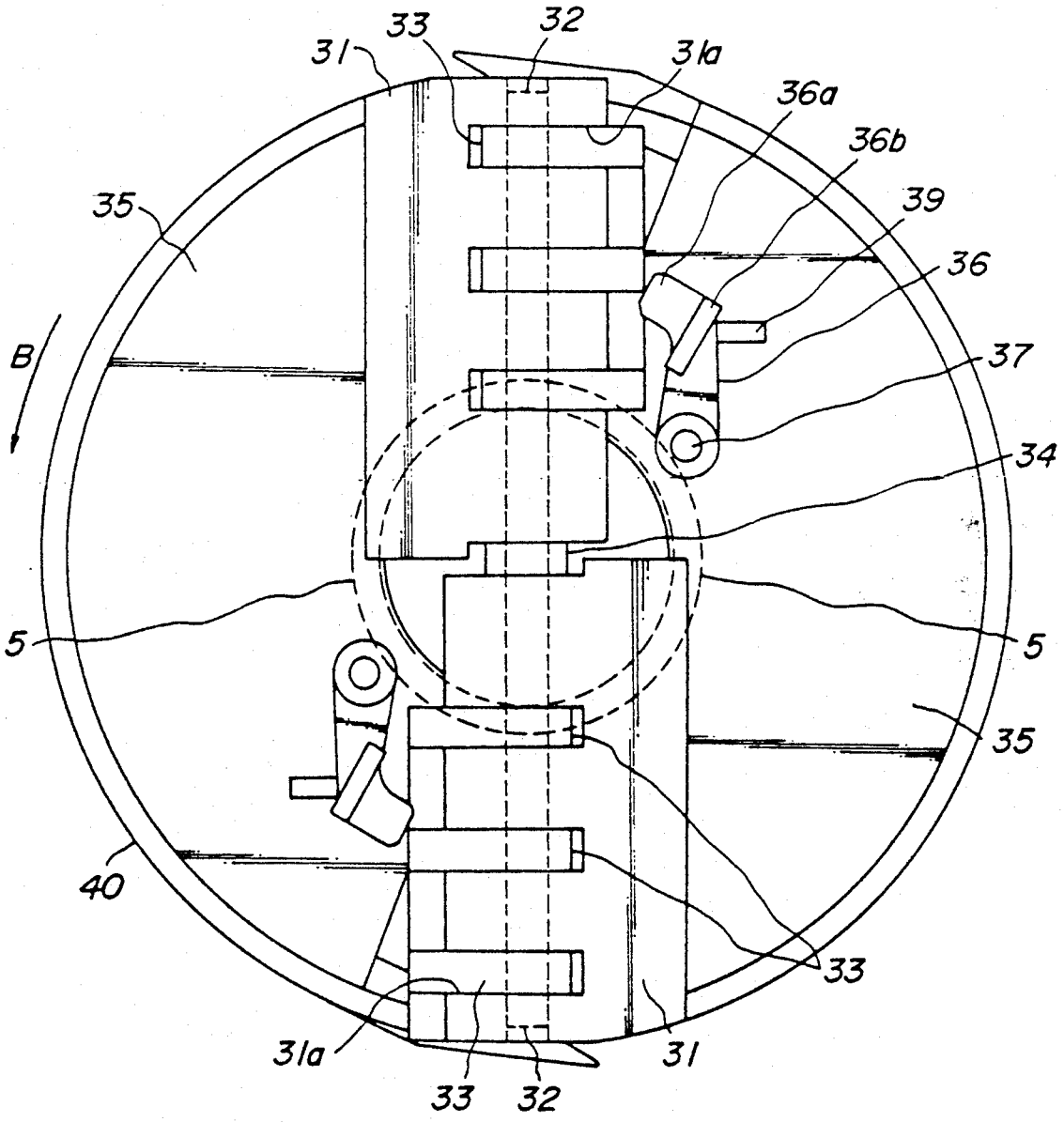
FIG. 10*b* is a bottom plan view of the excavating bits shown in FIG. 10*a;*

In more detail, referring to FIGS. 10*a* and 10*b* illustrating the excavating bits 31 carrying out the excavating operation, the auger bits are rotated in a direction shown by an arrow B in FIG. 10*b* so that the projecting pieces 31*c* abut against the support members 38 to keep the front edges 31*b* of the bits downwardly inclined as shown in FIG. 10*a*. At this time, the stoppers 36 are clear of the bits 31 and engage the stopping pieces 39.

Figure 11A:
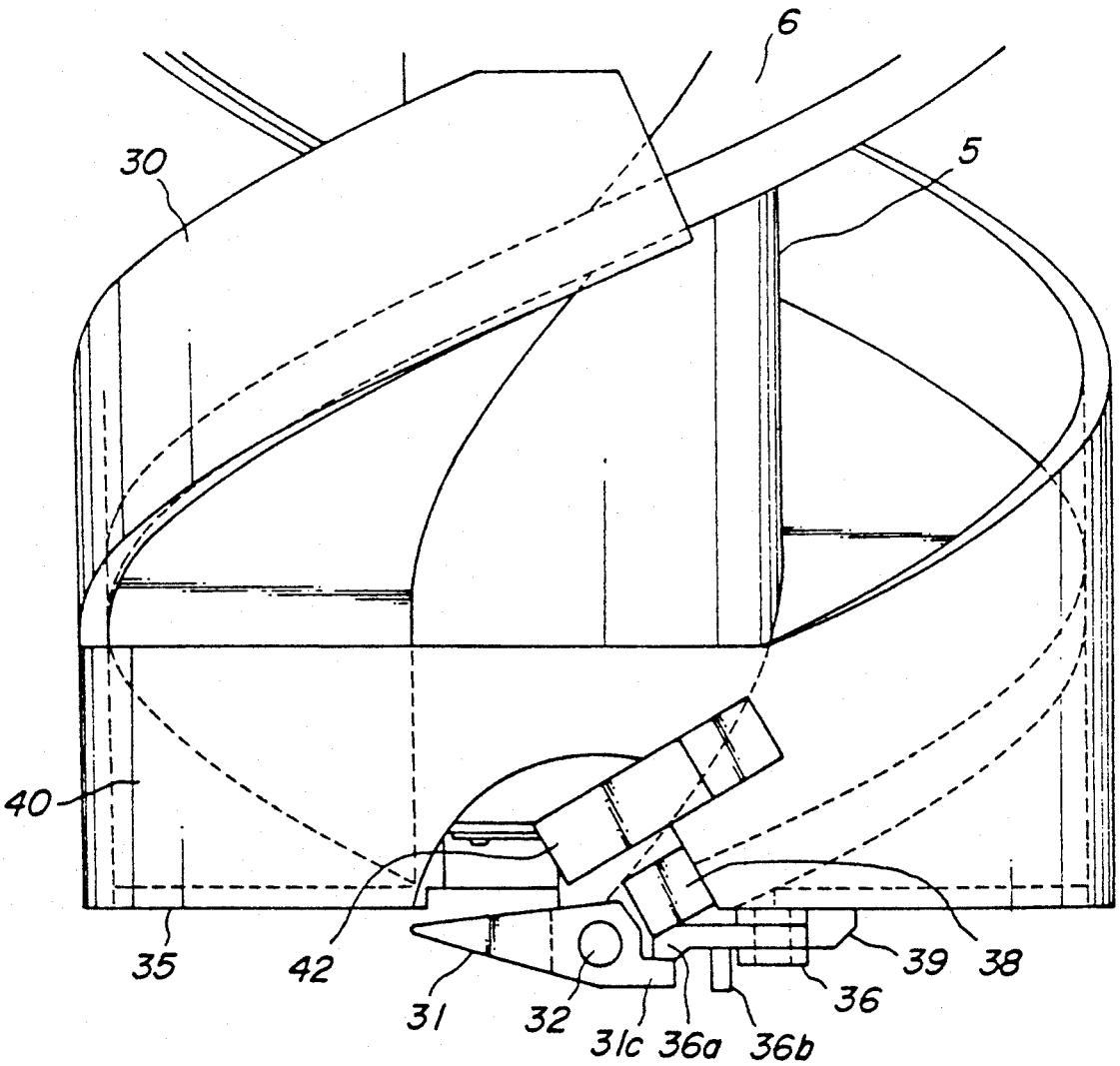
FIG. 11*a* is a partial view illustrating the excavating bits closing bottom plates after completion of excavating.
Figure 11B:
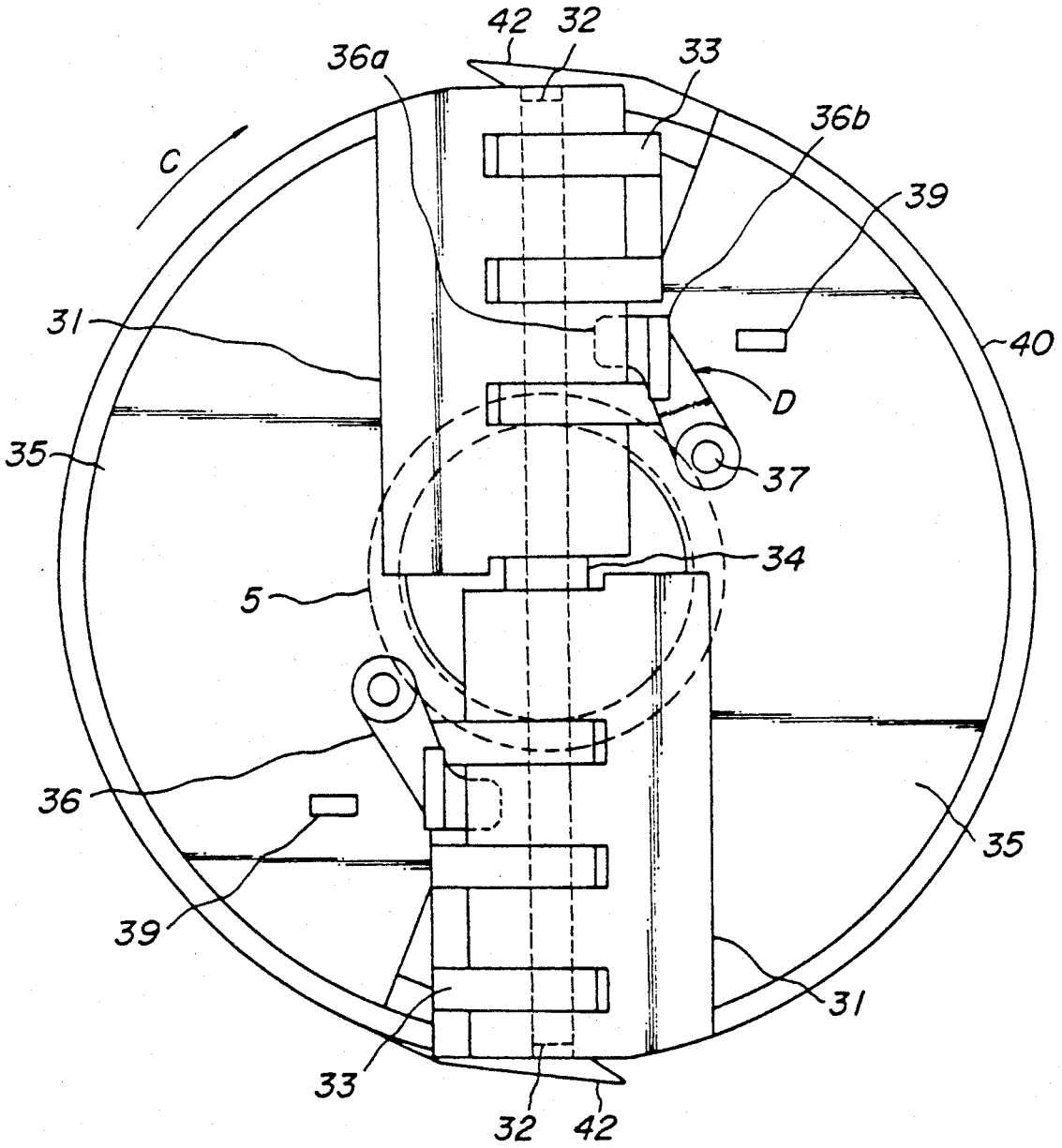
FIG. 11*b* is a bottom plan view of the bits shown in FIG. 11*a;*

Referring to FIGS. 11*a* and 11*b* illustrating the invention auger head is rotated in the reverse direction after the excavating has been completed, the auger head is rotated in the reverse direction shown by an arrow C in FIG. 11*b* so that the excavating bits 31 are closed relative to the bottom plates 35 as shown in FIG. 11*a*. Therefore, the projecting pieces 31*c* of the bits 31 are clear of the support members 38, and the free ends 36*a* of the stoppers 36 engage upper surfaces of the projecting pieces 31*c* to prevent the bits 31 from opening relative to the bottom plates 35.

Figure 5:
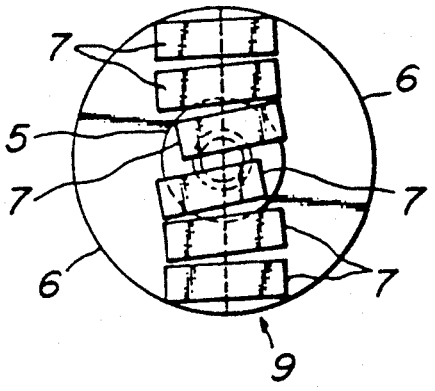
FIG. 5 is a bottom plan view of the auger head shown in FIG. 4.

In other words, when the earth auger is rotated in the direction shown by the arrow C in FIG. 5, the stoppers 36 are rotated about the shafts 37 in a direction shown by an arrow D in FIG. 11*b* with the aid of the resisting pieces 36*b* to cause the free ends 36*a* of the stoppers 36 to engage the upper surfaces of the projecting pieces 31*c* of the bits 31.

A bottom circumferential plate 40 in the form of a cylinder having a constant thickness is provided around the outer circumference of the bottom plates 35 so as to be continuous with the spiral belts 30. The bottom circumferential plate 40 is formed with semicircular notches 41 upwardly extending and diametrically opposed outer ends of the bits. Lateral bits 42 are arranged in the semicircular notches 41 and extend obliquely downwardly as shown in FIG. 10*a*.

The hollow shaft 5 is provided at the lower end with an outlet 43 (FIG. 9*b*) which comprises sector rubber valves 44 formed by equally dividing a circular rubber plate through a center into eight sector rubbers. A side of each of the sector rubber valves 44 is fixed to a fixing member of the auger head through a belt-like washer 45 by two sets screws 46 for exhausting fluids such as bentonite suspensions supplied through the hollow shaft 5.

Figure 8A:
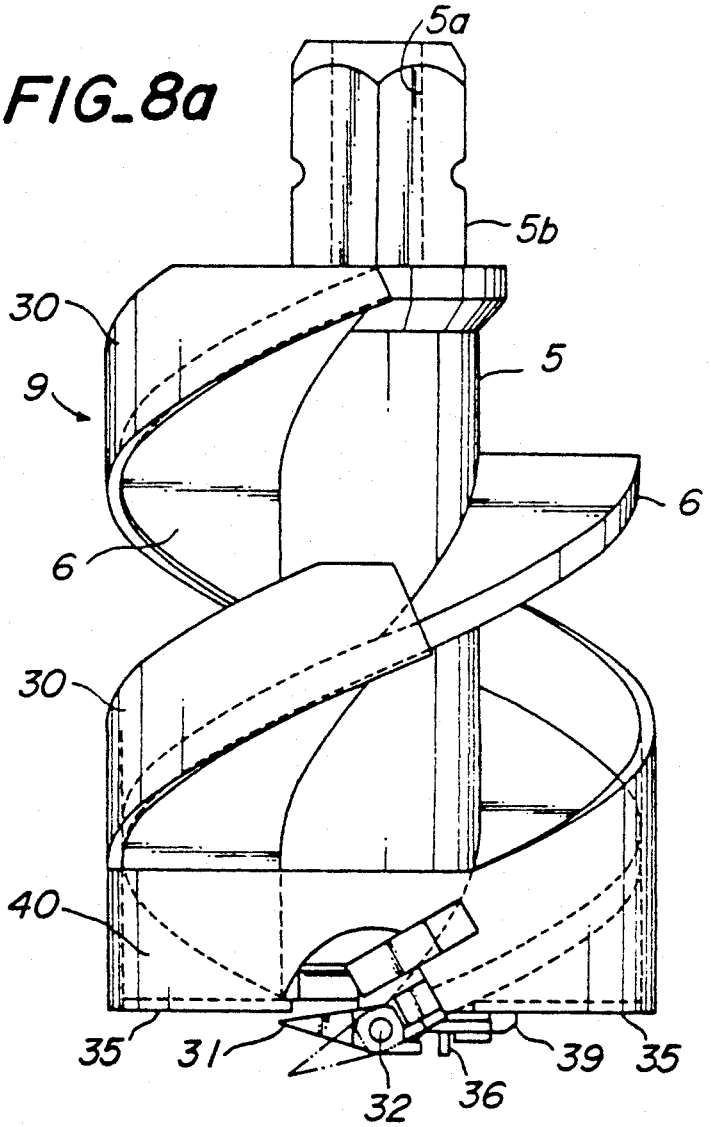
FIG. 8*a* is a front elevation illustrating an auger head used at the lower end of the apparatus shown in FIG. 7.
Figure 8B:
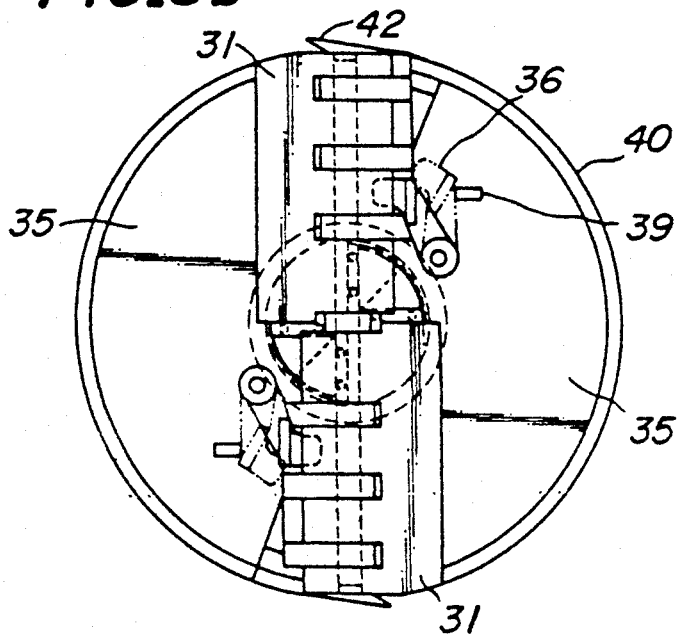
FIG. 8*b* is a bottom plan view of the auger head shown in FIG. 8*a;*
Figure 9A:
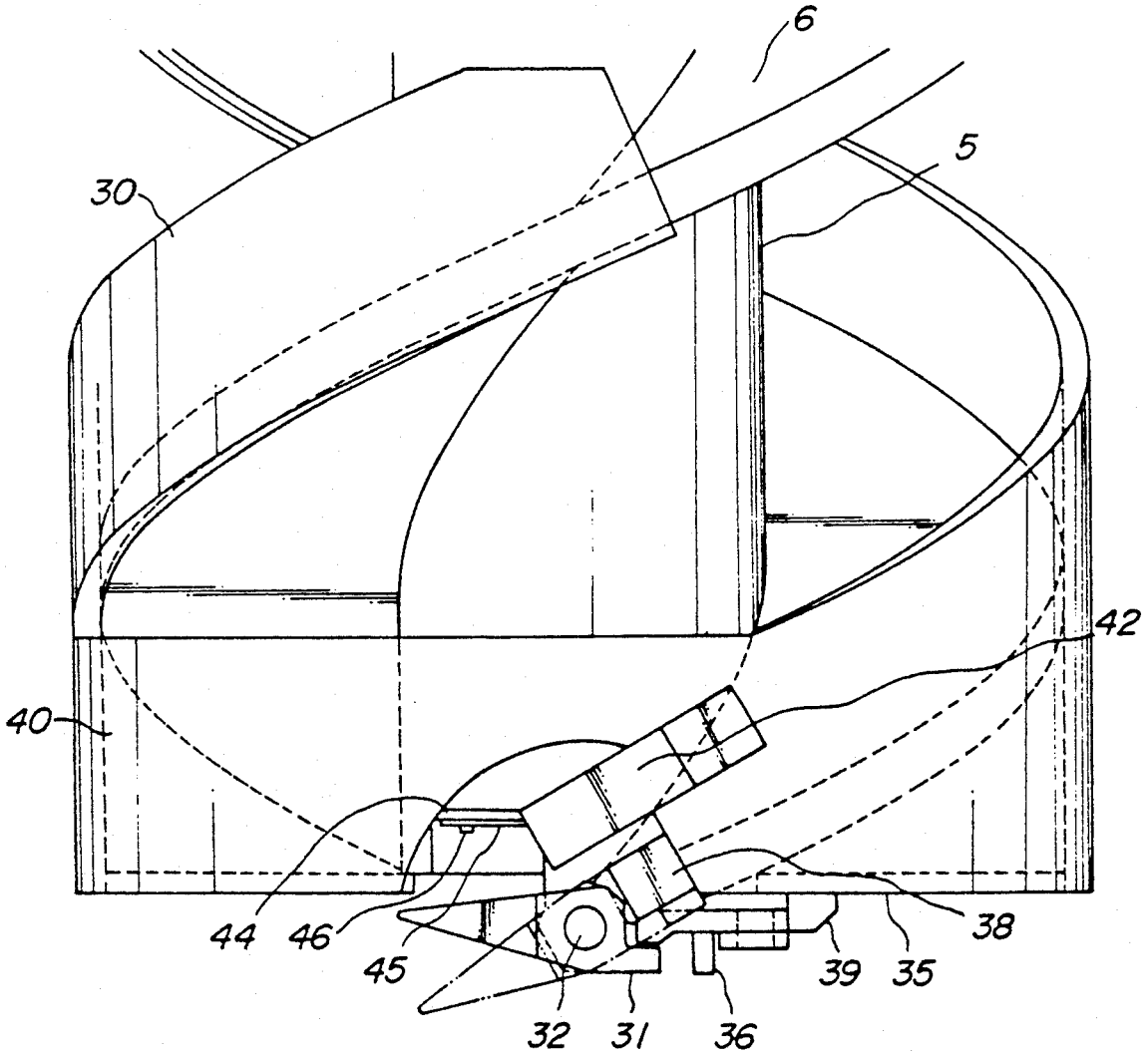
FIG. 9*a* is a partial detailed view of the auger head shown in FIG. 8*a;*
Figure 9B:
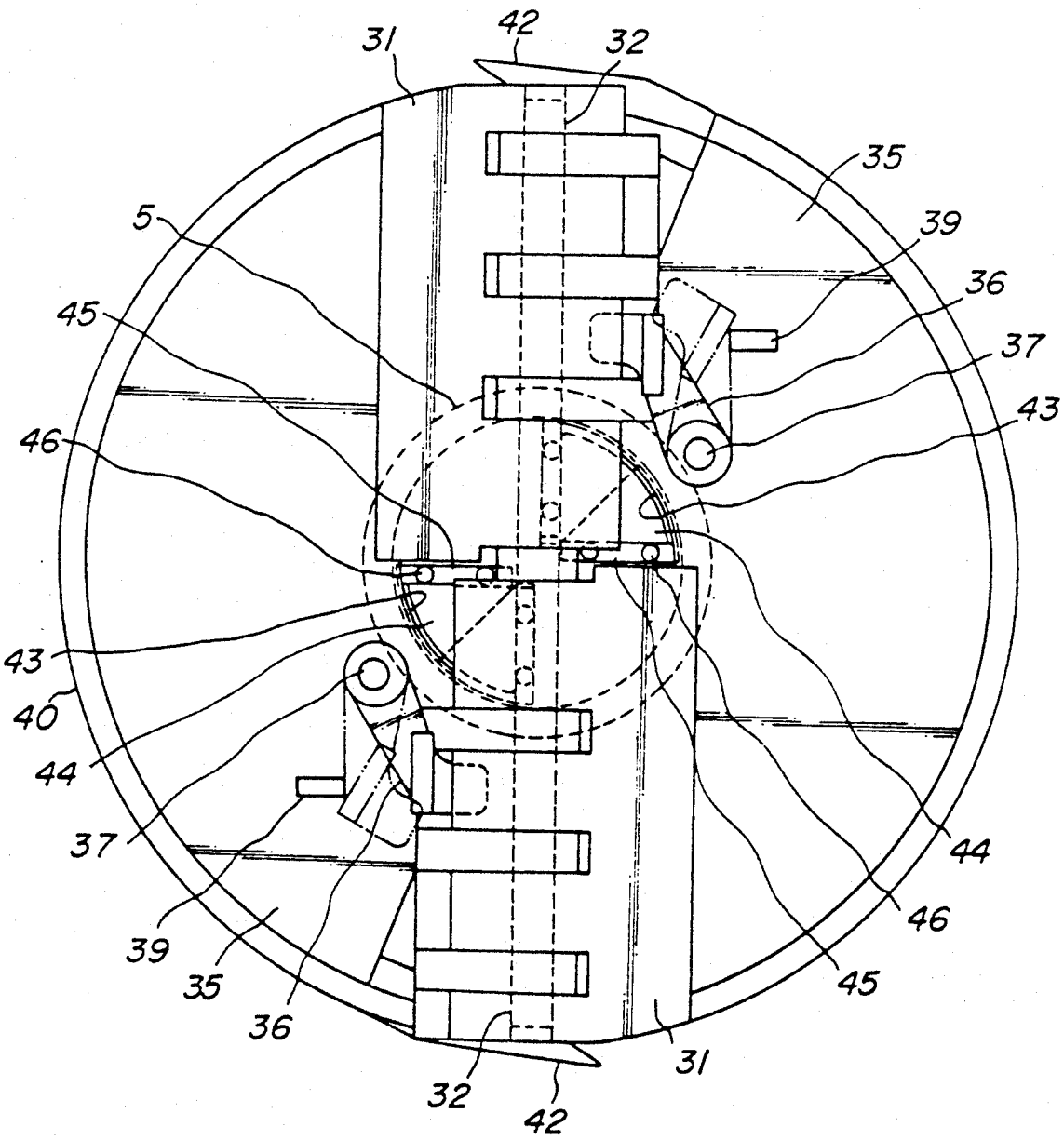
FIG. 9*b* is a bottom plan view of the auger head shown in FIG. 9*a;*

The auger head 9 as shown in FIGS. 8*a* and 8*b* is formed in the manner as above described.

Referring to FIG. 8*a*, moreover, the hollow shaft 5 is provided at its upper end with a coupling insert shaft 5*b*. The coupling insert shaft 5*b* is inserted into the coupling sleeve 1*c* shown in FIG. 7, and two bolts 12 are inserted therebetween so that the earth auger main body 4 and the auger head 9 are connected to form an earth auger 13 for a cast-in-place pile.

The cast-in-place piling method according to the invention using the earth auger 13 is FIG. 7 will not be explained since this is similar to that already explained by referring to FIG. 6.

As can be seen from the above description according to this embodiment the hollow shafts 1 and 5 of the earth auger main body 4 and the auger head 9 are provided thereabout with the spiral screw blades 2 and 6, and the screw blades 2 and 6 are provided on their outer circumferences with spiral belts 3 and 30 in parallel with outer circumferential surfaces of the hollow shafts 1 and 5. As a result, excavated earth and sand are maintained about the hollow shafts 1 and by means of the screw blades 2 and 6 and the spiral belts 3 and 30.

In this embodiment, particularly, the spiral belts 30 are provided on the auger head 9 to increase holding the excavating earth and sand by the auger head to further reduce crumbling of the excavated earth and sand.

Moreover, as the spiral belts 3 and 30 are provided on the screw blades 2 and 6 such that the spiral belts are fixed with their lower edges to the screw blades as shown in the embodiment in FIGS. 7 to 11*a* and 11*b*, the prevention of the crumbling of the excavated earth and sand is further improved.

Moreover, in this embodiment the spiral screw blades 6 are doubly provided about the hollow shaft 5 of the auger head 9 and the spiral belts 30 are provided on the outer circumferences of the screw blades 6 in parallel with the outer circumferential surface of the hollow shaft 5. Furthermore, the excavating bits 31 are provided at the ends of the screw blades 6 respectively, and the bottom plates 35 are provided at the ends of the screw blades except the proximity of the bits 31. The bits 31 are adapted to close and open relative to the bottom plates 35. When the earth auger is rotated in the reverse direction, the stoppers 36 pivotally connected to the bottom plate 35 are rotated so as to engage the rear ends of the excavating bits 31 to keep the excavating bits 31 in the closed position. Therefore, in the case that the auger head 9 is pulled up after hole excavating has been completed, the excavated earth and sand are received above the bottom plates, while the excavating bits 31 opened in excavating are rotated to close the opening of the bottom plates.

Therefore, by using the auger head 9 according to the invention, remaining earth and sand in the excavated hole can be removed in a reliable manner.

As above described, the invention has significant effects in that the cast-in-place piling method can be effected more easily, quickly and exactly in comparison with the methods of the prior art.

Figure 12:
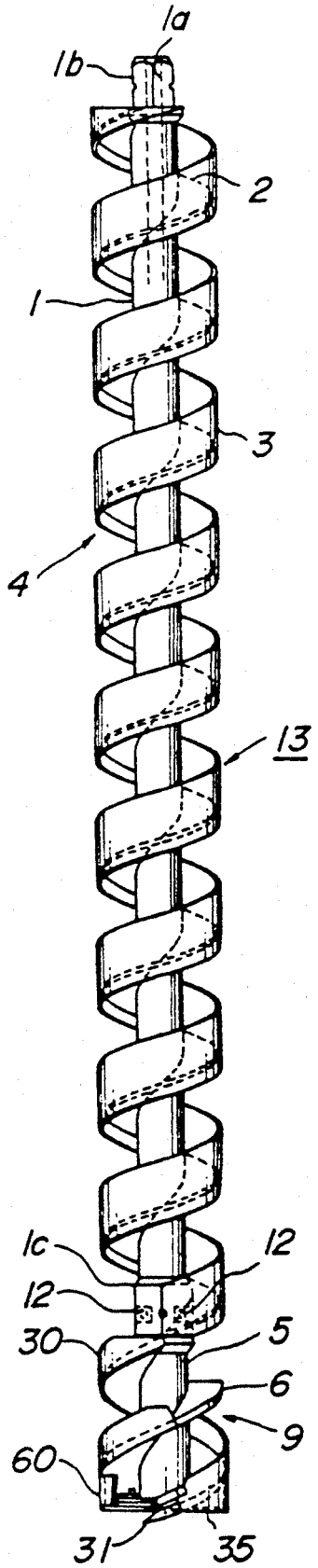
FIG. 12 is a general view illustrating a third embodiment of the apparatus according to the invention.
Figure 13A:
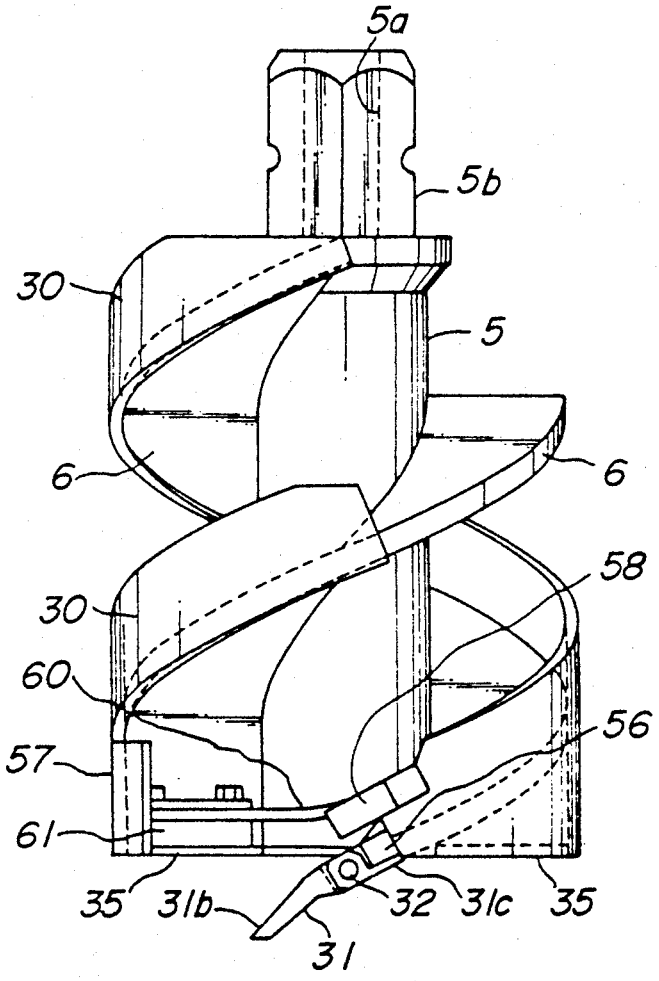
FIG. 13*a* is a front elevation illustrating an auger head used in the apparatus shown in FIG. 12.
Figure 13B:
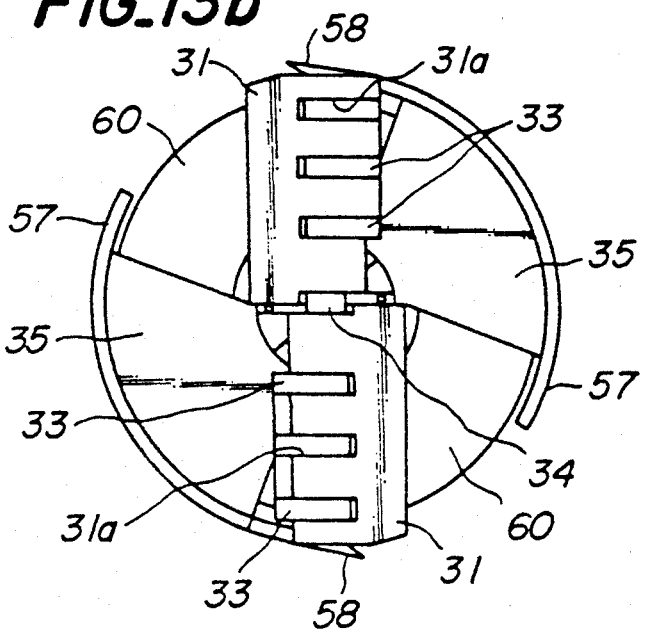
FIG. 13*b* is a bottom plan view of the auger head shown in FIG. 13*a;*

FIG. 12 illustrates a further embodiment of the apparatus or earth auger according to the invention. The like parts as those in the second embodiment are designated by the same reference numerals. An earth auger main body shown in FIG. 12 is substantially the same as that shown in FIG. 1 and will not be described in further.

As shown in FIGS. 13*a* to 15*b*, the earth auger of the embodiment comprises spiral screw blades 6, spiral belts 30, excavating bits 31 in the form of combs, and brackets 33 and 34 in the similar manner to those in the second embodiment shown in FIGS. 7 to 12*a* and 12*b* and these will not be explained further.

Bottom plates 35 of the auger head are fixed to the lower ends of the hollow shaft 5 and are fixed to the spiral belts 30 except the fitted portions of the excavating bits 31 and suitable front areas on the side of front edges 31*b* of the excavating bits 31 (zones of sectors having angles of about 90° and centers coincident with a center of the hollow shaft 5 in this embodiment). The excavating bits 31 are adapted to close and open relative to a plane of the bottom plates 35 as shown in arrows E in FIG. 14*a*. Moreover, in order to keep the excavating bits 31 in excavating positions during the earth auger being rotated for excavating, supporting members 56 adapted to abut against the projecting pieces 31*c* are fixed to the lower end of the screw blades 6.

A bottom circumferential plate 57 in the form of a cylinder having a constant thickness is provided around the circumference of the bottom plate 35 to be continuous with the spiral belts 30. Lateral bits 58 are provided on lower ends of the spiral belts 30 and the bottom circumferential plate 57 and extend in obliquely downwardly.

Elastic plates 60 (FIG. 14*a*) curved in a ¼ circular arc in a plan view are made of an elastic material such as rubber to cover spaces or openings 59 (FIG. 15*a*) of the bottom plates 35. These elastic plates 60 are arranged so that their one ends 60*a* are fixed through bases 61 to edges of the bottom plates 35 opposed to the excavating bits 31 and their free ends 60*b* overlap the lower ends of the screw blades 6.

Figure 14A:
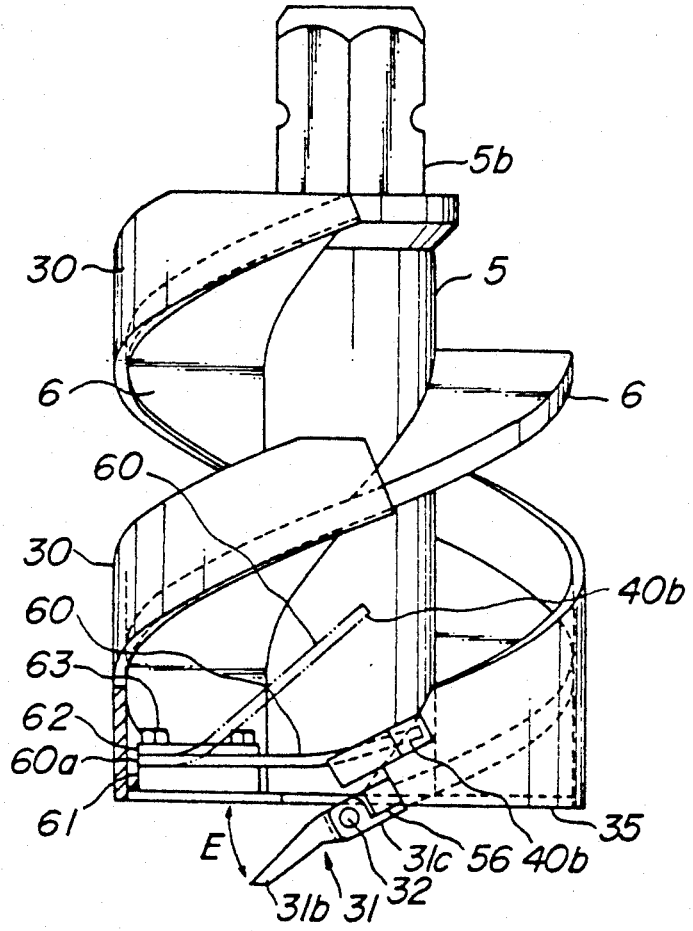
FIG. 14*a* is a view for explaining operation of the auger head shown in FIG. 13*a;*
Figure 14B:
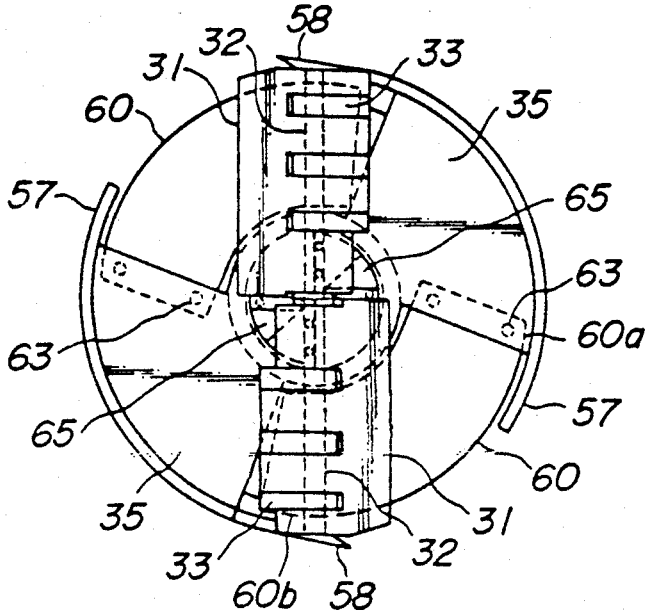
FIG. 14*b* is a bottom plan view of the auger head of FIG. 14*a;*

The one ends 60*a* of the elastic plates 60 are fixed to the bases 61 by means of retaining plates 62 and set screws 63 (FIG. 14*a*).

Figure 15A:
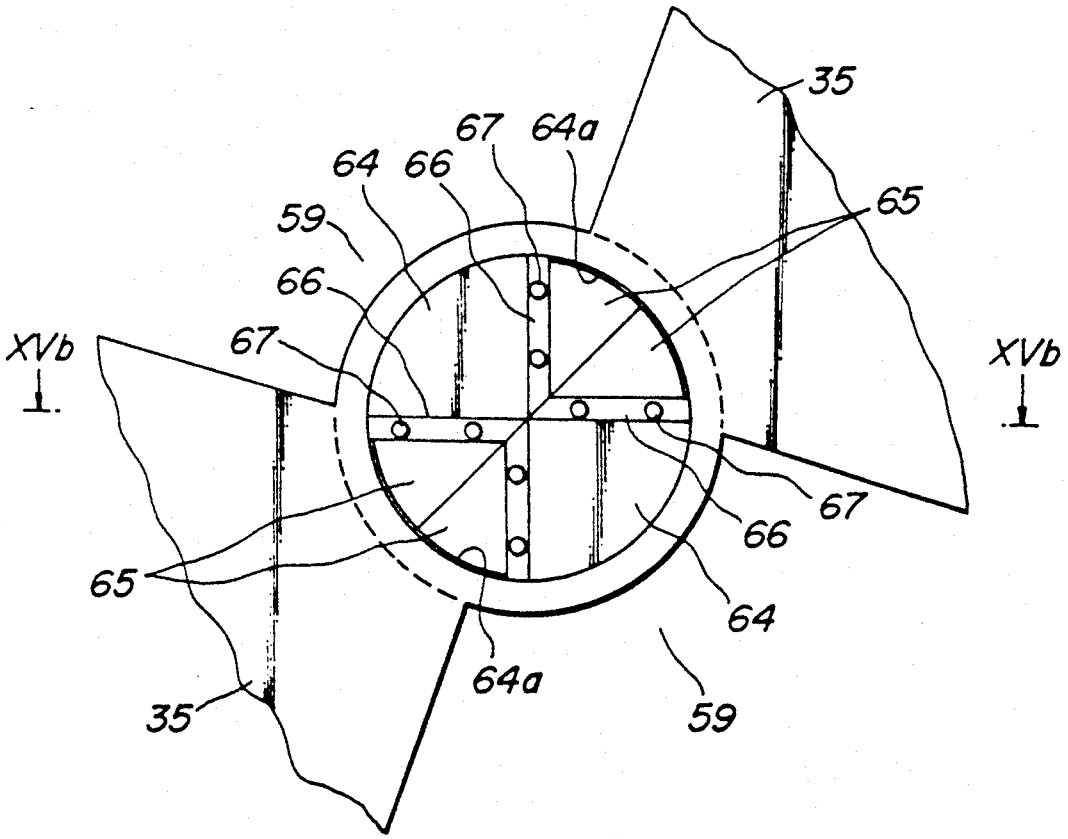
FIG. 15*a* is a partial view illustrating a lower end of a hollow shaft of the auger head.
Figure 15B:
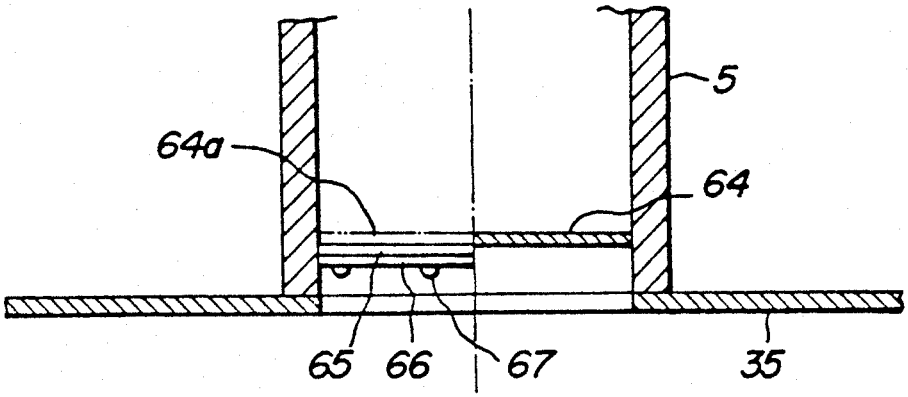
FIG. 15*b* is a sectional view of the auger head taken along the line XVb—XVb in FIG. 15*a*.

As shown in FIGS. 15*a* and 15*b*, partition plates 64 are provided in the proximity of the lower end of the hollow shaft 5 and have exhaust openings or outlets 64*a* in the form of ¼ arcuate shape at two locations diametrically opposed. Each of the outlets 64*a* comprises a sector rubber valve 65 formed by equally dividing a circular rubber plate through a center into eight sector rubbers and is fixed with sides to edges of the outlet of the partition plate 64 through belt-like washers 66 by means of two set screws 67 for exhausting fluids such as bentonite suspensions supplied through the hollow shaft 5.

The auger head 9 as shown in FIGS. 13*a*, 13*b*, 14*a* and 14*b* is formed in the manner as above described.

The earth auger main body 4 and the auger head 9 are connected to form an earth auger 13 for a cast-in-place pile in the same manner as in the second embodiment.

When the ground is excavated by the use of the earth auger 13 as above described, the excavating bits 31 excavate the ground under the condition shown in FIG. 14*a* so that the elastic plates 60 are bent as shown in broken lines in FIG. 14*a* with their free ends 60*b* being raised upward.

Therefore, excavated earth and sand are moved through between the elastic plates 40 and the excavating blades 31 to be received in the auger head 9.

When the excavating has been completed, the rotation of the earth auger 13 is stopped and the earth auger 13 is then pulled up. As a result, the elastic plates 60 are returned into the horizontal position as shown in the solid lines in FIG. 14*a* with the aid of a restortion resulting from its elasticity and the weight of the excavated earth and sand accumulated thereabove, thereby preventing the excavated earth and sand from falling down.

The cast-in-place piling method using the earth auger 13 of the third embodiment as above described is substantially the same as that explained by referring to FIGS. 6*a* to 6*f* so that the method will not be explained.

According to the third embodiment, excavated earth and sand are maintained about the hollow shafts 1 and 5 by means of the screw blades 2 and 6 and the spiral belts 3 and 30, and crumbling of the excavated earth and sand is further reduced with the aid of the spiral belts 30 in the same manner as in the second embodiment. Moreover, the prevention of the crumbling of the excavated earth and sand is further improved by positioning the blades 2 and 6 at lower edges of the spiral belts as in the second embodiment.

According to the third embodiment, furthermore, the bottom plate 35 is provided on the lower ends of the hollow shaft 5 and the spiral belts 30 except the fitted portion of the excavating bits 31 and suitable front areas on the side of front edges 31*b* of the excavating bits 31, and the elastic plates 60 covering the spaces or openings 59 are fixed with their one ends 40*a* to the inside of the bottom plates 35. Therefore, when excavating, the elastic plates 60 are bent upwardly to receive the earth and sand excavated by the bits 31 in the interior of the auger head 9, but when the auger head is pulling up after completion of excavation, the elastic plates 60 are returned to the horizontal position so as to automatically close the outlets provided in the bottom plates 35 to prevent the excavated earth and sand from falling down.

Therefore, by using the auger head 9, remaining earth and sand in the excavated hole can be eliminated in a reliably manner.

As above described, the invention has significant effects in that the cast-in-place piling method can be effected more easily, quickly and exactly in comparison with the methods of the prior art.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A cast-in-place piling method employing an earth auger main body having a hollow shaft, a spiral screw blade being provided about the hollow shaft, and a spiral belt being provided on an outer circumference of the spiral screw blade and being substantially parallel with an outer circumferential surface of the hollow shaft, and an auger head being provided at a lower end of the earth auger main body and having check means for preventing excavated earth and sand from flowing in a return direction as the earth auger is rotated in a reverse direction, said spiral belt being provided over substantially the entire length of said earth auger main body;

said method comprising the steps of excavating the ground to a predetermined depth by rotating said earth auger in a normal direction so that said earth auger penetrates the ground to said predetermined depth; placing said excavated earth and sand on said spiral screw blade; rotating said earth auger in the reverse direction thereby actuating said check means raising the earth auger together with excavated earth and sand; retaining excavated earth and sand on said spiral screw blade by said spiral belt to enable the earth and sand to be removed from the excavated hole; inserting reinforcing steel into the excavated hole; and pouring cement paste through a tremie pipe into the excavated hole to successively accumulate from the bottom to the top of the hole.

2. A method as in claim 1, wherein in the step of raising the earth auger includes pouring bentonite suspension through a hole of said hollow shaft to replace the excavated earth and sand formerly in the excavated hole with the bentonite suspension.

3. A method as in claim 1, wherein the step of raising the earth auger includes pouring water through a hole of said hollow shaft to replace the excavated earth and sand formerly in the excavated hole with the water.

4. An apparatus for placing a cast-in-place pile comprising an earth auger main body having a hollow shaft, a spiral screw blade provided about the hollow shaft, a spiral belt provided on an outer circumference of the spiral screw blade and substantially parallel with an outer circumferential surface of the hollow shaft; and an auger head being connected to a lower end of the earth auger main body and having another hollow shaft, excavating bits being provided at a lower end of the spiral screw blade, and check means being provided on the spiral screw blade for preventing excavated earth and sand from flowing in a return direction as the auger head is rotated in a reverse direction said spiral belt being provided over substantially the entire length of said earth auger main body.

5. An apparatus as in claim 4, wherein said check means comprises a plate being pivotally connected to a portion of the spiral screw blade of the auger head on the lower end of the spiral screw blade, being pivotally moved by the excavated earth and sand into a first position permitting the excavated earth and sand to flow and being pivotally moved by excavated earth and sand into a second position preventing the excavated earth and sand from flowing in the return direction.

6. An apparatus as in claim 5, wherein said plate is pivotally connected to a bracket being provided on the spiral screw blade of the auger head.

7. An apparatus as in claim 4, wherein said check means comprises bottom plates being fixed to the lower end of the spiral belt of the auger head and not fixed to the excavating bits, said excavating bits being pivotable with respect to said screw blade, said bottom plate having openings which are opened and closed by the pivoted action of said excavating bits, and elastic plates being provided inside the bottom plates and having edges being fixed to the bottom plates for covering holes in the bottom plates at the lower end of the spiral belt.

8. An apparatus as in claim 7, wherein said bottom plates are fixed to the lower end of the spiral belt and not fixed to zones of sectors having angles of about 90° and having centers coincident with a center of the hollow shaft of the auger head, and said elastic plates forming a ¼ circular arc.

9. An apparatus as in claim 4, wherein said auger head comprises a spiral belt being provided on an outer circumference of the spiral screw blade of the auger head and being parallel with an outer circumferential surface of the hollow shaft.

10. An apparatus as in claim 9, wherein a lower edge of the spiral belt is fixed to the screw blade of the auger head.

11. An apparatus as in claim 4, wherein a lower edge of spiral belt is fixed to the screw blade of the earth auger main body.

12. An apparatus as in claim 4, wherein two spiral screw blades are provided about the hollow shaft of the auger head.

13. A cast-in-place piling method employing an earth auger main body having a hollow shaft, a spiral screw blade being provided about the hollow shaft, and a spiral belt being provided on an outer circumference of the spiral screw blade and being substantially parallel with an outer circumferential surface of the hollow shaft, and an auger head being provided at a lower end of the earth auger main body and having check means for preventing excavated earth and sand from flowing in a return direction when the earth auger is rotated in a reverse direction, said spiral belt being provided over substantially the entire length of said earth auger main body; said method comprising the steps of excavating the ground to a predetermined depth by rotating in a normal direction with said earth auger so that said earth auger penetrates the ground to said predetermined depth, rotating said earth auger in the reverse direction thereby actuating said check means and raising the earth auger together with excavated earth and sand; retaining said excavated earth and sand on said spiral screw blade by said spiral belt to enable the earth and sand to be removed from the excavated hole and pouring cement paste through a tremie pipe into the excavated hole to successively accumulate cement paste from the bottom to the top of the hole.

14. An apparatus for placing a cast-in-place pile comprising an earth auger main body having a hollow shaft, a spiral screw blade provided about the hollow shaft, a spiral belt provided on an outer circumference of the spiral screw blade and substantially parallel with an outer circumferential surface of the hollow shaft; and an auger head being connected to a lower end of the earth auger main body and having a hollow shaft, excavating bits being provided at a lower end of the spiral screw blade, and check means being provided on the spiral screw blade for preventing excavated earth and sand from flowing in a return direction as the auger head is rotated in a reverse direction, wherein said check means comprises bottom plates being fixed to the lower end of the spiral belt of the auger head and not being fixed to the excavating bits, said excavating bits being pivotable with respect to said screw blade, said bottom plates having openings which are opened and closed by the pivotal action of said excavating bits, and stoppers being pivotally connected to the bottom plates and being movable by excavated earth and sand to engage the excavating bits to maintain the excavating bits in a position to close said opening.

15. An apparatus as in claim 14, wherein said excavating bits are comb-shape, said excavating bits having a plurality of notches into which are fitted brackets, said brackets being fixed to the auger head, and a shaft pivotally supporting the excavating bits and being inserted in the brackets.

16. An apparatus as in claim 14, wherein said stoppers are arm shaped, said stoppers having bottoms being pivotally connected to the bottom plate and having free ends being formed with resistance pieces such that excavated earth and sand move the stoppers clear of the excavating bits as said free ends of the stoppers engage projecting pieces of the excavating bits to hold the bits in said closed positions as the auger head is rotated in the reverse direction.

17. An apparatus for placing a cast-in-place pile comprising an earth auger main body having a hollow shaft, a spiral screw blade provided about the hollow shaft, a spiral belt provided on an outer circumference of the spiral screw blade and substantially parallel with an outer circumferential surface of the hollow shaft; and an auger head being connected to a lower end of the earth auger main body and having another hollow shaft, excavating bits being provided at a lower end of the spiral screw blade, and check means being provided on the spiral screw blade for preventing excavated earth and sand from flowing in a return direction as the auger head is rotated in a reverse direction, wherein said check means comprises bottom plates being fixed to the lower end of the spiral belt of the auger head and not fixed to the excavating bits, said excavating bits being pivotable with respect to said screw blade, said bottom plate having openings which are opened and closed by the pivoted action of said excavating bits, and elastic plates being provided inside the bottom plates and having edges being fixed to the bottom plates for covering holes in the bottom plates at the lower end of the spiral belt.

18. An apparatus as in claim 17 wherein there are two said bottom plates, each being generally pie-shaped and occupying approximately ¼ of the circular arc and being diametrically opposed to each other, the apexes of said plates being at a center approximately coincident with the center of the hollow shaft of the auger head.

* * * * *